US005116522A

United States Patent [19]

Brown et al.

[11] Patent Number: 5,116,522

[45] Date of Patent: May 26, 1992

[54] GREASE COMPOSITION CONTAINING AN ETHYLENE COPOLYMER HAVING A MELT INDEX OF AT LEAST ABOUT 40

[75] Inventors: Terrance O. Brown, Corunna; David A. Siack, Sarnia; A. Gordon Alexander, Sarnia; Lyle E. Moran, Sarnia, all of Canada

[73] Assignee: Exxon Research and Engineering Company, Florham Park, N.J.

[21] Appl. No.: 397,542

[22] Filed: Aug. 23, 1989

Related U.S. Application Data

[63] Continuation-in-part of Ser. No. 241,655, Sep. 8, 1988, abandoned.

[51] Int. Cl.[5] ..... C10M 145/14

[52] U.S. Cl. ..... 252/18; 252/25; 252/36; 252/37; 252/40.5; 252/42

[58] Field of Search ..... 252/17, 38, 39, 51.5 R, 252/36, 28, 35, 40, 41, 56 R, 18, 25, 37, 40.5, 42

[56] References Cited

U.S. PATENT DOCUMENTS

| | | | |
|---|---|---|---|
| 2,737,494 | 3/1956 | Frank | 252/39 |
| 3,010,899 | 11/1961 | Boyer | 252/29 |
| 3,112,270 | 11/1963 | Mitacek | 252/41 |
| 3,453,211 | 7/1969 | Philips | 252/56 R |
| 3,705,853 | 12/1972 | Fau et al. | 252/36 |
| 3,904,534 | 9/1975 | Sayles | 252/36 |
| 3,929,651 | 12/1975 | Murray et al. | 252/41 |
| 3,997,455 | 12/1976 | Sayles | 252/36 |
| 4,110,233 | 8/1978 | Bailey et al. | 252/41 |
| 4,115,343 | 9/1978 | Guillaume et al. | 260/33.6 |
| 4,253,979 | 3/1981 | Alexander et al. | 252/33.6 |
| 4,661,276 | 4/1987 | Stemke | 252/51.5 A |
| 4,904,399 | 2/1990 | Waynick | 252/11 |

FOREIGN PATENT DOCUMENTS

35089/78 4/1978 Australia .

OTHER PUBLICATIONS

Chemical Abstracts, vol. 93 (1980) Dec., No. 22, Columbus, Ohio U.S.A.

*Primary Examiner*—Prince Willis, Jr.
*Assistant Examiner*—Jerry D. Johnston
*Attorney, Agent, or Firm*—John W. Ditsler

[57] ABSTRACT

A lubricating composition having improved high and low temperature properties is disclosed. More specifically, the addition of a certain ethylene copolymers having a Melt Index of at least about 40 g/10 mins. to a mixture comprising (1) a lubricating oil, (2) a thickener, and (3) a VI improver results in a lubricating composition which has both excellent high temperature adhesiveness and low temperature slumpability.

21 Claims, No Drawings

GREASE COMPOSITION CONTAINING AN ETHYLENE COPOLYMER HAVING A MELT INDEX OF AT LEAST ABOUT 40

CROSS-REFERENCE TO RELATED APPLICATIONS

This application is a continuation-in-part of U.S. Ser. No. 241,655 filed Sept. 8, 1988, now abandoned.

BACKGROUND OF THE INVENTION

1. Field of the Invention

This invention relates to a lubricating composition having improved low and high temperature properties, to its method of preparation, and to its use, particularly as an open gear lubricant.

2. Description of Related Art

Frequently, lubricating compositions are used in applications that require satisfactory performance at both hot and cold temperature extremes. Examples of these applications include swing gears on mine shovels, large open gears on ball mills, and the like. A major complaint by users of this type of product is that it becomes very brittle at cold temperatures and tends to "run-off" at warmer temperatures.

Various combinations of additives have been suggested to rectify this problem. For example, U.S. Pat. No. 3,705,853 discloses a grease composition comprising a lubricating oil, a thickener, and an ethylene terpolymer having a Melt Index in the range of 0.5 to 200. Although viscosity index agents may be present, there is no mention of the grease containing an ethylene copolymer (See also U.S. Pat. No. 3,904,534).

However, ethylene copolymers have been incorporated into a variety of lubricating compositions. For example, U.S. Pat. No. 4,115,343 discloses that the storage stability and antifoaming tendency of organosiloxane polymers in mineral oil can be improved by adding ethylene-vinyl acetate copolymer (EVA) to the dispersion. As another example, U.S. Pat. No. 3,250,714 discloses that EVA is a VI improver for mineral lubricating oils. However, no mention is made of the Melt Index of the polymer. In U.S. Pat. No. 3,947,368, EVA having a Melt Index of from 5 to 580 is used as a pour point depressant in waxy lube oils. No mention is made, however, of a thickener being present.

Therefore, none of these references teach or suggest a lubricating composition having the excellent low temperature slumpability and high temperature adhesiveness of the composition described hereinafter.

SUMMARY OF THE INVENTION

This invention, in its broadest embodiment, concerns a lubricating composition having improved low temperature and high temperature properties. More specifically, a lubricating composition comprising (1) a lubricating oil, (2) a thickener, (3) a VI improver, and (4) a copolymer of ethylene with at least one compound selected from the group of vinyl acetate, alkyl acrylate, or alkyl methacrylate, has been found to have both excellent high temperature adhesiveness and low temperature slumpability. The ethylene copolymer used in this invention must have a Melt Index of at least about 40 g/10 mins. and should contain from about 10 to about 40 wt.% vinyl acetate, alkyl acrylate, or alkyl methacrylate. Preferably, the Melt Index should be between about 40 and about 10,000, more preferably between about 40 and about 5000, and most preferably between about 40 and about 2500, g/10 mins.

In another embodiment, this invention concerns a method for increasing the slumpability of a lubricating composition at a temperature below about −20° C. and increasing its adhesiveness at a temperature above about +20° C.

DETAILED DESCRIPTION OF THE INVENTION

The essential components of this invention are a lubricating oil, a thickener, a VI improver, and a copolymer of ethylene with at least one compound selected from the group of vinyl acetate, alkyl acrylate, or alkyl methacrylate.

A wide variety of lubricating oils can be employed in preparing the composition of this invention. Accordingly, the lubricating oil base can be any of the conventionally used mineral oils, synthetic hydrocarbon oils, or synthetic ester oils. In general, these lubricating oils will have a viscosity in the range of about 5 to about 10,000 cSt at 40° C., although typical applications will require an oil having a viscosity ranging from about 10 to about 1,000 cSt at 40° C. Mineral lubricating oil base stocks used in preparing the lubricating composition can be any conventionally refined base stocks derived from paraffinic, naphthenic, and mixed base crudes. Synthetic lubricating oils that can be used include esters of dibasic acids such as di-2-ethylhexyl sebacate, esters of glycols such as a $C_{13}$ oxo acid diester of tetraethylene glycol, or complex esters such as the ester formed from 1 mole of sebacic acid, 2 moles of tetraethylene glycol, and 2 moles of 2-ethylhexanoic acid. Other synthetic oils that can be used include synthetic hydrocarbons such as polyalphaolefins; alkyl benzenes (e.g., alkylate bottoms from the alkylation of benzene with tetrapropylene, or the copolymers of ethylene and propylene silicon oils, e.g., ethyl phenyl polysiloxanes, methyl polysiloxanes, etc.); polyglycol oils (e.g., those obtained by condensing butyl alcohol with propylene oxide); and carbonate esters (e.g., the product of reacting $C_8$ oxo alcohol with ethyl carbonate to form a half ester followed by reaction of the latter with tetraethylene glycol, etc.). Other suitable synthetic oils include the polyphenyl ethers, e.g., those having from about 3 to 7 ether linkages and about 4 to 8 phenyl groups. (See U.S. Pat. No. 3,424,678, column 3.) Normally, the lubricating oil will comprise a major amount of the lubricating composition. Typically, the amount of lubricating oil will range from above about 50 to about 90 wt.%, preferably from about 70 to about 85 wt.%, of the lubricating composition.

The lubricating composition will also contain a thickener dispersed in the lubricating oil to form a base grease. However, the particular thickener employed is not critical and can vary broadly. For example, the thickener may be based on aluminum, barium, calcium, lithium, sodium soaps, or their complexes. Soap thickeners may be derived from a wide range of animal oils, vegetable oils, and greases as well as the fatty acids derived therefrom. These materials are well known in the art and are described in, for example, C. J. Boner, Manufacture and Application of Lubricating Greases, Chapter 4, Robert E. Krieger Publishing Company, Inc., New York (1971). Carbon black, silica, and clays may be used as well as dyes, polyureas, and other organic thickeners. Pyrrolidone based thickeners can also be used. Preferred thickeners are based on clay, a pyrrolidone, an aluminum soap, a barium soap, a calcium soap, a lithium soap, a sodium soap, or complexes of the soaps. Particularly preferred thickeners are based on lithium soap, calcium soap, aluminum soap, their complexes, or mixtures thereof. More preferred thickeners are based on lithium soap, calcium soap, their complexes, or mixtures thereof. Most preferred is a lithium or lithium complex thickener that incorporates an hydroxy fatty acid having from 12 to 24 (preferably from 16 to 20) carbon atoms. A preferred hydroxy fatty acid is an hydroxy stearic acid (e.g., a 9-hydroxy or a 10-hydroxy stearic acid) of which 12-hydroxy stearic acid is most preferred (See U.S. Pat. No. 3,929,651, the disclosure of which is incorporated herein by reference). The amount of thickener in the lubricating composition will typically range from about 1 to about 15 wt.%. For most purposes, between about 1 to about 10 wt.%, preferably between about 2 to about 5 wt.%, of the thickener will be present in the composition.

A VI improver will be present in the lubricating composition as well. Viscosity modifiers are long chain, generally high molecular weight polymers (including polyesters) that impart high and low temperature operability to the lubricating composition by permitting it to remain relatively viscous at elevated temperatures and fluid at low temperatures. Viscosity modifiers may also be derivatized to include other properties or functions, such as the addition of dispersancy properties. Oil soluble viscosity modifying polymers useful in this invention will generally have number average molecular weights of from about 300 to about $10^6$, preferably from about 500 to about $10^4$, and more preferably from about 1,000 to about 2,000. The amount of VI improvers present in the lubricating composition will vary depending upon the particular VI improver used, its molecular weight, and the like. Typically, however, from about 5 to about 40 wt.% (preferably from about 10 to about 30 wt.%) of the lubricating composition will be VI improver.

Suitable VI improvers may be based on hydrocarbon polymers, polyesters, or mixtures thereof. Examples of suitable hydrocarbon polymer VI improvers include homopolymers and copolymers of two or more monomers of $C_2$ to $C_{30}$ (e.g., $C_2$ to $C_8$ olefins, including both alpha olefins and internal olefins, which may be straight or branched, aliphatic, aromatic, alkyl-aromatic, cycloaliphatic, and the like). Frequently the VI improver will be a polymer of isobutylene or a copolymer of ethylene, propylene, butene, or isobutylene with a $C_3$ to $C_{30}$ olefin. A polymer of isobutylene or a copolymer of butene and isobutylene are preferred, with a polymer of isobutylene being particularly preferred. Other polymers which can be used include homopolymers and copolymers of $C_6$ and higher alpha olefins; atactic polypropylene; hydrogenated polymers, copolymers, and terpolymers of styrene (e.g., with isoprene and/or butadiene and hydrogenated derivatives thereof). The polymer may be degraded in molecular weight by mastication, extrusion, oxidation, thermal degradation, etc., and may contain oxygen.

Suitable VI improvers also include the polyester V.I. improvers, which are generally polymers of esters of ethylenically unsaturated $C_3$ to $C_8$ mono- and dicarboxylic acids such as methacrylic and acrylic acids, maleic acid, maleic anhydride, fumaric acid, etc. Examples of unsaturated esters that may be used include those of aliphatic saturated mono alcohols of at least 1 carbon atom and preferably of from 12 to 20 carbon atoms such as decyl acrylate, lauryl acrylate, stearyl acrylate, decyl methacrylate, diamyl fumarate, cetyl methacrylate, and the like, and mixtures thereof. Other esters include the vinyl alcohol esters of $C_2$ to $C_{22}$ fatty or monocarboxylic acids such as vinyl acetate, vinyl laurate, vinyl stearate, and the like, and mixtures thereof. Preferably, the $C_2$ to $C_{22}$ fatty or monocarboxylic acids are saturated. Copolymers of vinyl alcohol esters with unsaturated acid esters, such as the copolymer of vinyl acetate with dialkyl fumarates, can also be used.

The lubricating composition will also contain a copolymer of ethylene with at least one compound selected from the group of vinyl acetate, alkyl acrylate, or alkyl methacrylate. Vinyl acetate is the preferred ethylene copolymer. The copolymer must have a Melt Index of at least about 40 g/10 min and should have a copolymer content of from about 10 to about 40 wt.%, preferably from about 10 to about 30 wt.%. Preferably, the Melt Index should range from about 40 to about 10,000, more preferably from about 40 to about 5000, and most preferably from about 40 to about 2500, g/10 mins. The amount of copolymer added should range from about 1 to about 20 wt.% (preferably from about 1 to about 10 wt.%) based on total weight of the composition.

The particular VI improvers and polymers employed can be readily obtained in the marketplace from various chemical suppliers. Thus, their methods of preparation are well known to those skilled in the art.

The lubricating composition may also contain small amounts of supplemental additives which include, but are not limited to, anticorrosive agents, extreme pressure antiwear agents, pour point depressants, tackiness agents, oxidation inhibitors, dyes, and the like, which are incorporated for specific purposes. The total amount of these additives will typically range from about 2 to about 5 wt.% based on total weight of the lubricating composition. In addition, solid lubricants such as molybdenum disulfide and graphite may be present in the composition—typically from about 1 to about 5 wt.% (preferably from about 1.5 to about 3 wt.%) for molybdenum disulfide and from about 3 to about 15 wt.% (preferably from about 6 to about 12 wt.%) for graphite.

One or more solvents (typically from about 10 to about 40 wt.%) may be added to the lubricating composition as a diluent to improve its dispensing properties. Suitable solvents include pure hydrocarbon solvents, mixed hydrocarbon solvents, chlorhydrocarbon solvents, or mixtures thereof, which will typically have an atmospheric boiling point between about 30° and about 300° C.

Suitable pure hydrocarbon solvents include toluene, ortho-xylene, meta-xylene, mesitylene, ethylbenzene, butylbenzene, hexane, heptane, octane, isooctane, etc., or their mixtures. Typically, these solvents will have a solid (or melting) point below about −25° C. (preferably below −40° C.).

Suitable mixed hydrocarbon solvents include kerosine, varsol, naphtha, etc., or their mixtures. Typically, these solvents will have a pour point below about −25° C., preferably below about −40° C.

Suitable chlorohydrocarbon solvents include n-propylchloride, isopropyl chloride, n-butylchloride, iso-butylchloride, sec-butylchloride, pentylchloride, hexylchloride, dichloromethane, trichloromethane, 1,1-dichloroethane, 1,2-dichloroethane, trichloroethylene, chlorobenzene, etc., and their mixtures, with 1,1,1-trichloroethane being particularly preferred.

The lubricating composition of this invention is usually prepared by first dispersing or mixing the thickener in the lubricating oil for from about 1 to about 8 hours or more (preferably from about 1 to about 4 hours) followed by heating at elevated temperature (e.g., from about 60° to about 260° C. depending upon the particular thickener used) until the mixture thickens. The mixture is then cooled to ambient temperature (typically about 25° C.) during which time the VI improver, ethylene copolymer, and other additives are added. Although the VI improver and ethylene copolymer can be added together or separately in any order, it is preferred that they be added as described below to obtain a lubricating composition having the desired low and high temperature properties.

As the mixture is cooled, it is preferred to add the ethylene copolymer (e.g., EVA) at a temperature between about 120° to about 180° C. Although the ethylene copolymer can be added at a temperature outside this range, the copolymer will tend to coalesce at lower temperatures and not be suitably dispersed in the mixture. At higher temperatures, the copolymer may be thermally unstable. Preferably, the VI improver is added at a temperature between about 80° and about 190° C. Additional lubricating oil may also be added within the latter temperature range to obtain the desired grease consistency and oil viscometric properties. Other additives (such as the supplemental additives and solid lubricants mentioned above) are normally added at a temperature between about 50° and about 100° C. Finally, at a temperature between ambient and about 50° C. (preferably between about 25° and about 40° C.), a solvent is added to the mixture to provide the required dispensibility. Lower temperatures are preferred for solvent addition to avoid excessive evaporation. Normally, the composition will be blended or mixed during addition of its components.

The components of the lubricating composition can be mixed, blended, or milled in any number of ways which can readily be selected by one skilled in the art. Suitable means include external mixers, roll mills, internal mixers, Banbury mixers, screw extruders, augers, colloid mills, homogenizers, and the like.

The lubricating composition of this invention may be suitably employed in essentially any application requiring good lubrication at both high and low temperatures. Examples of such applications include open gears, rollers, bearings, wire ropes, cables, and the like. The composition, however, is particularly well suited for use as an open gear lubricant.

In another embodiment, this invention concerns a method for increasing the slumpability of a lubricating composition at temperatures below about −20° C. and increasing its adhesiveness at temperatures above about +20° C., wherein the composition contains:

(a) a lubricating oil,
(b) a thickener, and
(c) a VI improver, which method comprises adding a copolymer of ethylene with at least one compound selected from the group of vinyl acetate, alkyl acrylate, or alkyl methacrylate that has a Melt Index of at least about 40 g/10 min. (preferably from about 40 to about 10,000, more preferably from about 40 to about 5000, and most preferably from about 40 to about 2500, g/10 mins) and a vinyl acetate, alkyl acrylate, or alkyl methacrylate content between about 10 and about 40 wt.%, preferably between about 10 and about 30 wt.%, to said composition.

This invention will be further understood by reference to the following Examples which are not intended to restrict the scope of the claims appended hereto.

EXAMPLE 1

Preparation of the Base Grease Composition

The base grease composition was prepared in a Hobart mixing apparatus. The open mixing vessel was equipped with heat tracing and thermal insulation. The vessel was charged with 300 grams of 12-hydroxy stearic acid and 915 g of 100 SUS (@100° F.) hydrotreated naphthenic distillate (available commercially as Exxon oil 1502) and the mixture heated to 70° C. with constant agitation. At 70° C., the mixture was neutralized by slowly adding 45 grams of $LiOH.H_2O$ in 150 grams of water over a one hour period, during which time the temperature was maintained between 70° and 110° C. After alkali addition was completed, the temperature was increased to 150° C. and maintained at that temperature until dehydration was completed. The alkali content was determined by acid titration to be 0.2 mass% (expressed as NaOH equivalent), which indicates neutralization is complete. The temperature of the mixture was then increased to between 190° and 200° C. and maintained within that range for about 30 minutes. Following this "cook-out", the mixture was then cooled to about 120° C. by the slow addition of 500 grams of Pennsylvania Resin (2600 SUS @210° F.) and 500 grams of polybutene (800 cSt at 100° C.), followed by the addition of 345 grams of Penn Resin and 86 grams of polybutene to obtain the desired oil viscosity (about 1000 cSt at 40° C.). Additional oil (3000 grams) was then added in six 500 gram aliquots, each containing 195 grams of 1502 oil, 180 grams of Penn Resin, and 125 grams of polybutene to obtain softer grease consistency while maintaining the desired ratio of mineral oil to VI improver. Oil additions were performed slowly to avoid formation of a separate oil phase. The composition was then passed once through a Charlotte colloid mill. The milled product had a cone penetration of 298 mm/10 as determined by ASTM D217.

A 3000 gram aliquot of the 298 mm/10 penetration product was returned to the mixing vessel and six additional 500 gram aliquots of the 1502/Penn Resin/-polybutene blend added. Because the mixing vessel was too small to obtain a base grease having the proper consistency, about 1000 grams of product were removed from the mixing vessel and another 500 gram aliquot of the blend added to the remaining product. The resulting final base grease had a consistency of 367 mm/10 as determined by ASTM D217 and the following composition:

| | |
|---|---|
| Lithium Hydroxide.$H_2O$ | 0.25 wt % |
| 12-Hydroxystearic Acid | 1.69 wt % |
| 100 SUS @ 100° F. Hydrotreated Naphthenic Distillate | 38.22 wt % |
| Pennsylvania Resin (2600 SUS @ 210° F.) | 35.31 wt % |
| Polybutene (800 cSt @ 100° C.) | 24.53 wt % |

The lubricating compositions employed in Examples 2 and 3 (below) were prepared from this base grease as follows. About 400 g of base grease was mixed with the required amount of each of the following commercially available polymers at 125° C. The 60 strokes worked penetration of each mixture was then measured by ASTM D217.

TABLE 1

| Polymer | Description | Melt Index, g/10 min. |
|---|---|---|
| A | Ethylene vinyl acetate, 14% VA | 2500 |
| B | Ethylene vinyl acetate, 28% VA | 2500 |
| C | Ethylene vinyl acetate, 12% VA | 10 |
| D | Ethylene vinyl acetate, 28% VA | 39 |
| E | Styrene-butadiene-styrene, 70% butadiene/30% styrene (SBS) MW 160,000 | — |
| F | Linear low density polyethylene (LLDPE) | 20 |

The mixtures were then cooled and mixed with trichloroethane to obtain a final solvent concentration of 25 wt.% in the compositions tested.

EXAMPLE 2

Effect of Various Polymers on Low Temperature Slumpability

The tendency of each polymer modified composition prepared in Example 1 to slump (i.e. flow) was determined from the Cone Yield Value. To determine the Cone Yield, a round 90 mm diameter by 60 mm deep container was filled with a sample of each composition and the surface smoothed with a spatula if required. Each sample was cold soaked for 4 hours at −40° C. and then the penetration determined with a standard grease penetrometer, the description of which is given in ASTM D217. For this measurement, a special right-angle cone measuring 62 mm at the base was used. The total weight of the cone and shaft was 66.7 grams. The penetration at −40° C. was measured after 10 seconds instead of the 5 seconds employed in the usual test with the standard cone. The measurement was made within one minute of removing the sample from the cold box to avoid undue warming of the sample. The Cone Yield was calculated from the penetration at −40° C. using the formula shown below:

$$\text{Cone Yield @}-40^\circ\text{ C.} = \frac{(\text{weight of cone + shaft})}{\pi\,(\text{Pen @}-40^\circ\text{ C.}/100)^2}$$

Past experience has shown that Cone Yield values of less than about 80 are characteristic of lubricants with good slumpability.

The Cone Yield Value of each sample was determined and the results obtained summarized in Table 2.

TABLE 2

| Polymer | MI | Conc., wt % | X60 Pen. mm/10 (1) | Pen @-40° C., mm/10 (2) | Cone Yield, g/cm$^2$ |
|---|---|---|---|---|---|
| A | 2500 | 2 | 390 | 60 | 59 |
| B | 2500 | " | 378 | 55 | 70 |
| C | 10 | " | 358 | 60 | 59 |
| D | 39 | " | 374 | 39 | 39 (3) |
| E | — | " | 375 | 53 | 76 |
| F | 20 | " | 355 | 74 | 39 |
| A | 2500 | 6 | 370 | 92 | 25 |
| B | 2500 | " | 364 | 51 | 81 |
| C | 10 | " | 347 | 83 | 30 |
| D | 39 | " | 347 | 29 | — |
| E | — | " | 240 | 20 | 532 |
| F | 20 | " | (4) | (4) | (4) |

(1) 60 strokes worked penetration before solvent addition.
(2) Penetration at −40° C. on final product.
(3) An average of duplicate samples which gave yields of 34 and 43.
(4) Sample was not prepared because the polymer could not be dispersed in the base grease.

The data in Table 2 show that the samples containing polymers A–F have good slumpability at −40° C. and a concentration of 2 wt.%. However, at a concentration of 6 wt.%, the sample containing polymer E had poor slumpability and the sample containing polymer F could not be prepared.

EXAMPLE 3

Effect of Various Polymers on High Temperature Adhesiveness

The adhesiveness of the samples prepared in Example 1 was determined by spreading 10 grams of each sample on separate aluminum plates. The plates were then suspended vertically in a circulating oven for 24 hours at 65° C. The change in weight of each plate was then calculated on a solvent-free basis and the degree of surface coverage estimated visually. The results of these tests are shown in Table 3.

TABLE 3

| Polymer | MI | Conc., wt % | X60 Pen. mm/10 (1) | Weight Loss, wt % (2) | Bare Surface, Area % |
|---|---|---|---|---|---|
| None | — | — | 367 | 72 | 80% bare patch |
| A | 2500 | 2 | 390 | 54 | Even coverage |
| B | 2500 | " | 378 | 48 | Even coverage |
| C | 10 | " | 358 | 41 | 20% bare patch |
| D | 39 | " | 374 | 40 | Even coverage |
| E | — | " | 375 | 76 | 60% bare patch |
| F | 20 | " | 355 | 40 | 40% bare patch |
| A | 2500 | 6 | 370 | 69 | Even coverage |
| B | 2500 | " | 364 | 66 | Even coverage |
| C | 10 | " | 347 | 63 | 60% bare patch |

(1) Values from Table 2.
(2) Weight loss is based on the trichloroethane-free product.

The data in Table 3 show that the samples containing 2500 MI EVA's (polymers A and B) performed well at concentrations of 2 and 6 wt.%, with observed weight losses ranging from 48 to 69%. Most important, however, at the end of the test the remaining composition formed an evenly distributed adhesive coating on the plate, with no bare surface evident. The sample containing polymer D (39 MI EVA) also performed well at a concentration of 2 wt.%. Both samples containing the SBS 416 (polymer E) and the LLDPE (polymer F) performed poorly, with large bare areas visible at the termination of the test period. Thus, only a lubricating composition containing polymers A, B, and D provided good adhesiveness at 65° C.

The data in Tables 2 and 3 show that both good adhesion at high temperature and good slumpability at low temperature are obtained for the samples containing polymers A, B and D—that is, ethylene-vinyl acetate copolymers having a Melt Index of at least about 40 g/mins. (most preferably from about 40 to about 2500 g/10 mins) and containing between about 10 and about 40 wt.% (preferably between about 10 and about 30 wt.%) vinyl acetate.

What is claimed is:

1. A lubricating composition which comprises:
(a) from above about 50 to about 90 wt.% of a lubricating oil,
(b) from about 1 to about 15 wt.% of a thickener,
(c) from about 5 to about 40 wt.% of a VI improver which is a polymer of isobutylene or a copolymer of ethylene, propylene, butene, or isobutylene with a $C_3$ to $C_{30}$ olefin, and
(d) from about 1 to about 10 wt.% of a copolymer consisting essentially of ethylene and vinyl acetate, alkyl acrylate, or alkyl methacrylate, wherein the copolymer has a Melt Index of at least about 40 g/10 min. and a vinyl acetate, alkyl acrylate, or alkyl methacrylate content between about 10 and about 40 wt.%.

2. The composition of claim 1 wherein the thickener is clay, a pyrrolidone, an aluminum soap, a barium soap, a calcium soap, a lithium soap, a sodium soap, or complexes of the soaps.

3. The composition of claim 2 wherein the thickener is an aluminum soap, a barium soap, a calcium soap, a lithium soap, a sodium soap, or their complexes.

4. The composition of claim 3 wherein the copolymer in (d) has a Melt Index ranging from about 40 to about 10,000 g/10 mins.

5. The composition of claim 4 wherein the copolymer in (d) has a Melt Index ranging from about 40 to about 5000 g/10 mins.

6. The composition of claim 5 wherein the thickener is a lithium soap or a lithium complex soap prepared from hydroxy fatty acid having from 12 to 24 carbon atoms.

7. The composition of claim 6 wherein the hydroxy fatty acid comprises 12-hydroxy stearic acid.

8. The composition of claim 7 wherein the VI improver is a polymer of isobutylene.

9. The composition of claim 8 wherein the VI improver has a molecular weight of from about 500 to about $10^4$.

10. The composition of claim 9 wherein the copolymer in (d) comprises ethylene-vinyl acetate.

11. The composition of claim 10 wherein the vinyl acetate content of the copolymer is between about 10 and about 30 wt.%.

12. The composition of claim 5 wherein the copolymer in (d) has a Melt Index ranging from about 40 to about 2500 g/10 mins.

13. The composition of claim 1 wherein the amount of copolymer (d) ranges from 2 to 6 wt.%.

14. A method for increasing the slumpability of a lubricating composition at temperatures below about −20° C. and increasing its adhesiveness at temperatures above about +20° C., wherein the composition contains:
(a) from above about 50 to about 90 wt.% of a lubricating oil,
(b) from about 1 to about 15 wt.% of a thickener which is an aluminum soap, a calcium soap, a lithium soap, their complexes, or mixtures thereof, and
(c) from about 5 to about 40 wt.% of a VI improver which is a polymer of isobutylene or a copolymer of ethylene, propylene, butene, or isobutylene with a $C_3$ to $C_{30}$ olefin, which method comprises adding the composition from about 1 to about 10 wt.% of a copolymer consisting essentially of ethylene and vinyl acetate, alkyl acrylate, or alkyl methacrylate, wherein the copolymer has a Melt Index of from about 40 to about 10,000 g/10 min. and a vinyl acetate, alkyl acrylate, or alkyl methacrylate content between about 10 and about 40 wt.%

15. The method of claim 14 wherein the copolymer of ethylene has a Melt Index ranging from about 40 to about 5000 g/10 mins.

16. The method of claim 15 wherein the thickener is a lithium soap or a lithium complex soap prepared from hydroxy fatty acid.

17. The method of claim 16 wherein the VI improver is a polymer of isobutylene.

18. The method of claim 17 wherein a pure hydrocarbon solvent, a mixed hydrocarbon solvent, a chlorohydrocarbon solvent, or mixtures thereof is added to the lubricating composition.

19. The method of claim 14 wherein the copolymer of ethylene has a vinyl acetate, alkyl acrylate, or alkyl methacrylate content between about 10 and about 30 wt.%.

20. The method of claim 15 wherein the copolymer of ethylene has a Melt Index ranging from about 40 to about 2500 g/10 mins.

21. The method of claim 17 wherein the amount of copolymer added ranges from 2 to 6 wt.%.

* * * * *